United States Patent [19]

Ptaszek et al.

[11] 4,005,545

[45] Feb. 1, 1977

[54] EYE SHIFTING MECHANISM FOR DOLL CONSTRUCTION

[75] Inventors: George W. Ptaszek, Pascoag; James A. King, Providence, both of R.I.

[73] Assignee: Hasbro Development Corporation, Pawtucket, R.I.

[22] Filed: Jan. 12, 1976

[21] Appl. No.: 648,951

[52] U.S. Cl. ..... 46/167; 46/168

[51] Int. Cl.[2] ..... A63H 3/40

[58] Field of Search ..... 46/165, 167, 168

[56] References Cited

UNITED STATES PATENTS

| | | | |
|---|---|---|---|
| 1,995,537 | 3/1935 | Dunner | 46/168 |
| 2,301,431 | 11/1942 | Marcus | 46/168 |
| 2,604,730 | 7/1952 | Weiss | 46/168 |

*Primary Examiner*—Russell R. Kinsey
*Assistant Examiner*—Robert E. Cutting
*Attorney, Agent, or Firm*—Salter & Michaelson

[57] ABSTRACT

A mechanism for effecting movement of simulated eyes as mounted in the head of a doll construction including an actuator mounted for rotating movement in the head and a connector member operatively connected to the actuator and being responsive to rotating movement thereof for movement in a linear direction, the eyes being interconnected to the connector member and being shiftable in response to linear movement thereof for location in a variety of selected positions to impart the impression of movement of said eyes.

10 Claims, 6 Drawing Figures

EYE SHIFTING MECHANISM FOR DOLL CONSTRUCTION

BACKGROUND OF THE INVENTION

The present invention relates to doll constructions in general and more particularly relates to a doll construction having a mechanism located in the head thereof, wherein eyes as mounted in the head are selectively movable to a variety of positions.

Some doll constructions as known heretofore have incorporated the general concept of providing for movement of simulated eyes as mounted in the head thereof, and in this connection lever-operated mechanisms for shifting the eyes as mounted in the head of a doll have been disclosed in U.S. Pat. Nos. 1,790,743; 1,821,243; 1,910,911 and 2,045,962. All of these prior known patents illustrate the use of a lever that protrudes from the head of a doll for actuating an eye mechanism as located therein. In addition, U.S. Pat. Nos. 2,273,836; 2,670,568; 3,287,848; 3,293,130 and 3,364,618 disclose doll constructions having eye members that are interconnected to an operating mechanism of some kind, usually in the doll body, which controls movement of the eyes.

Although these prior disclosures generally incorporated a mechanism for moving the eyes of a doll, they all included either a relatively complex construction that required a plurality of elements and parts that prohibitively increased the cost thereof, or were of such faulty construction that continued use thereof, as is normally experienced with a toy such as a doll, quickly resulted in the breaking of one or more of the elements as contained therein. As a result, none of the prior known mechanisms that incorporated an eye moving mechanism therein has been found practical for use in a relatively inexpensive doll.

SUMMARY OF THE INVENTION

The eye shifting mechanism for a doll construction as embodied in the present invention provides for mounting of simulated eyes in the head of the doll, the head being formed with an interior chamber in which sockets are located for receiving the eyes therein. Mounted in the head is an actuator that is formed with a guide that provides for rotating movement thereof. Operatively connected to the actuator is a connector member that is responsive to the rotating movement thereof for movement in a linear direction. Extensions are joined to the eyes and are interconnected to the connector member, the extensions being responsive to linear movement of the connector member for rotating the eyes to effect a shifting appearance thereof. An operator is joined to the actuator and extends outwardly of the head for exterior access by a user, the operator being movable to effect the rotating movement of the actuator and the corresponding linear movement of the connector member, thereby providing for movement of the eyes in the sockets to a variety of selected positions.

Accordingly, it is an object of the present invention to provide a mechanism for effecting movement of simulated eyes as mounted in the head of a doll construction, wherein the eyes are selectively movable to a variety of positions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
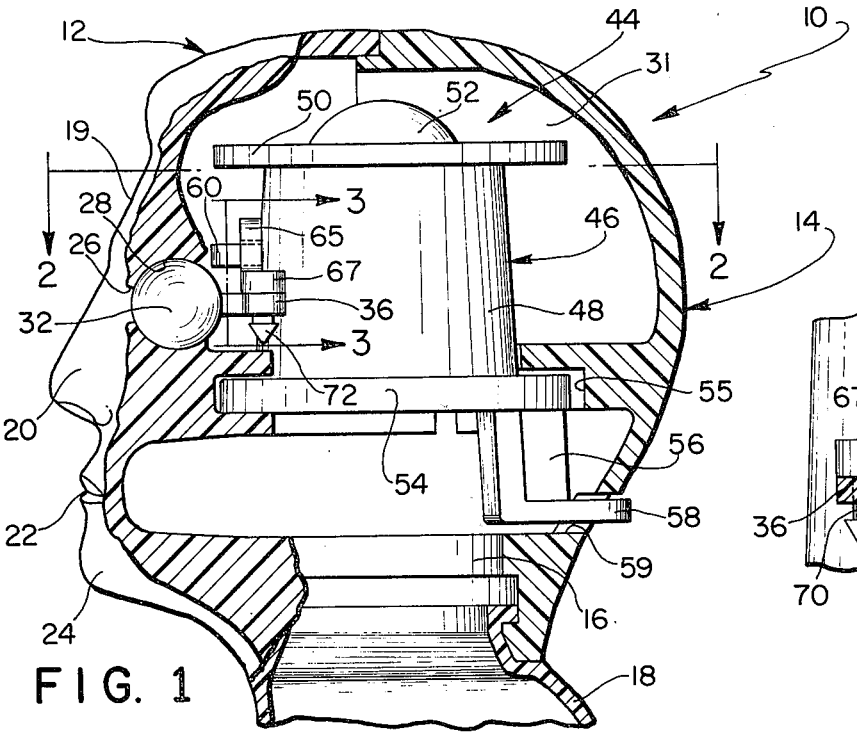
FIG. 1 is a sectional view of the head of a doll construction as embodied in the present invention, with the interior parts thereof shown in elevation.

The mechanism as embodied in the present invention is designed for use in a doll construction; and, although the mechanism has universal application insofar as the type of doll in which it is used, it is generally preferred that the mechanism be installed in the head of a doll having male characteristics. In this connection, and referring to FIG. 1, a head for a doll construction is generally indicated at 10; and, as shown, includes a front portion generally indicated at 12 that is attached to a rear portion generally indicated at 14. The front and rear portions 12 and 14 are secured together by any suitable means, such as an adhesive; but prior to the securement thereof, the mechanism for shifting the eyes of the doll is inserted therebetween, as will hereinafter be described. As further illustrated in FIG. 1, a neck member 16 projects upwardly from a body 18 of a doll of any conventional construction and is received in appropriate annular grooves that are located in a lower portion that defines the neck section of the head 10 and that are formed when the front and rear portions 12 and 14 are joined together.

Referring again to FIG. 1, the front portion 12 of the head 10, as shown, is formed with the facial characteristics of the doll head, which in addition to a forehead 19, a nose 20, lips 22 and a chin 24 include eye openings 26 and 27 that communicate with eye sockets 28 and 30 as formed interiorly of the front portion 12. The sockets 28 and 30 as located in the front portion 12 communicate with an interior chamber 31 that is formed when the front and rear portions 12 and 14 are secured together.

Figure 2:
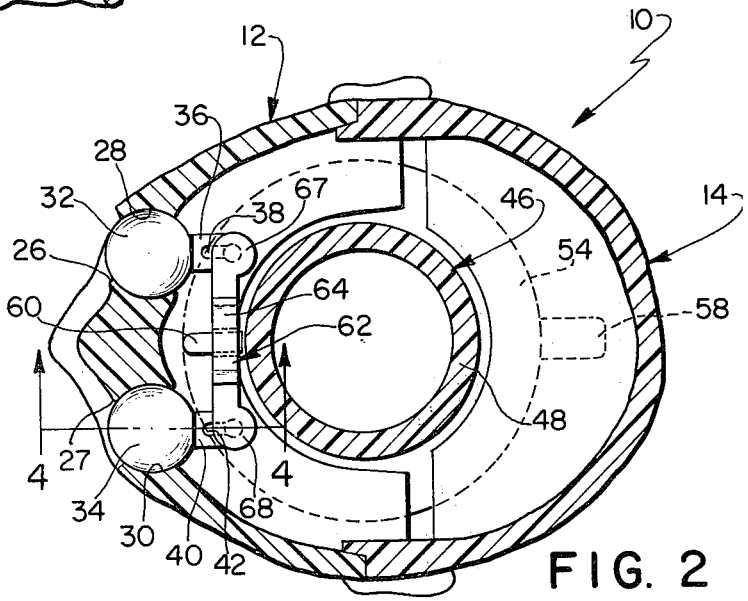
FIG. 2 is a sectional view taken along line 2—2 in FIG. 1.
Figure 5:
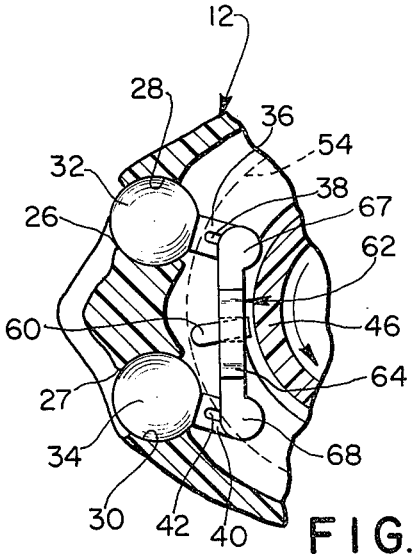
FIG. 5 is a fragmentary sectional view similar to FIG. 2 showing the movement of the eyes in one direction.
Figure 6:
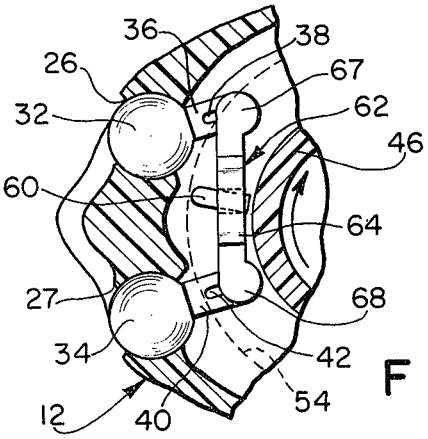
FIG. 6 is a fragmentary sectional view similar to FIG. 2, showing the movement of the eyes in another direction.

As shown more clearly in FIGS. 2, 5 and 6, spherical members 32 and 34 are received in the sockets 28 and 30 and define the eyes of the doll. The eyes 32 and 34 are exteriorly visible through the openings 26 and 27 formed in the front portion 12; and since the eyes 32 and 34 are formed with actual eye characteristics on the visible portions thereof, a realistic effect is achieved.

The principal object of the present invention is to pivotally move the spherical eyes 32 and 34 in their respective sockets so as to produce the effect that the doll has side vision as well as front vision, and in this connection the user of the doll is able to produce a sidewise glance of the doll as required in the play action thereof. In order to accomplish this purpose, the eye 32 has an extension 36 joined thereto in which a slot 38 is formed; while an extension 40 is joined to the eye 34 and has a slot 42 formed therein. As will hereinafter be described, the extensions 36 and 40 are jointly moved to produce the rotating or pivotal movement of the eyes 32 and 34 as required.

In order to produce the movement of the eyes 32 and 34, an actuating mechanism generally indicated at 44 is provided and comprises an actuator generally indicated at 46 that includes a tapered cylindrical body 48. Joined to the body 48 at the upper end thereof is a top flange 50 on which an upper central domed portion 52 is formed. A bottom flange 54 is secured to the lower end of the body 48 and is received in an annular groove 55 that is formed when the front and rear head portions 12 and 14 are secured together. As will be described the flange 54 defines a guide as it rotates within the groove 55. Depending from the bottom flange 54 is a lever 56 to which an actuating arm 58 is joined at right angles thereto. The arm 58 extends outwardly of the head 10 through a laterally extending slot 59 formed in the rear portion 14 of the head adjacent to the neck section thereof.

Figure 3:
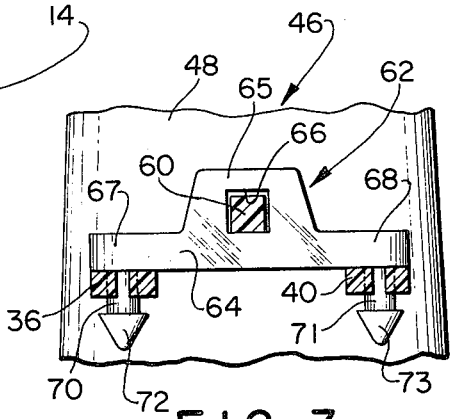
FIG. 3 is a sectional view taken along line 3—3 in FIG. 1.
Figure 4:
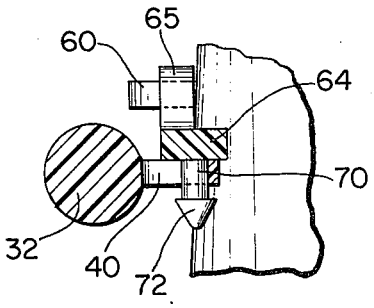
FIG. 4 is a sectional view taken along line 4—4 in FIG. 2.

As more clearly illustrated in FIGS. 3 and 4, a projection 60 is joined to the body 48 of the actuator 46 and extends forwardly thereof, the projection 60 having a generally square cross-sectional configuration. Mounted on the projection 60 and movable therewith is a connector member generally indicated at 62 that is defined by an elongated bar 64. Integrally joined to the central portion of the bar 62 is an upwardly extending portion 65 in which a square shaped opening 66 is formed that receives the projection 60 therein. Joined to enlarged outermost ends 67 and 68 of the bar 64 and depending therefrom are pins 70 and 71 on the lowermost ends of which arrow-shaped ends 72 and 73 are formed.

As illustrated in FIGS. 3 and 4, the pins 70 and 71 loosely extend through the openings 38 and 42 of the extensions 36 and 40, respectively, the ends 72 and 73 projecting below the extensions to the connector member 62. It is seen that longitudinal or linear movement of the connector member 62 will produce a corresponding pivotal movement of the extensions 36 and 40, and since the spherical eyes 32 and 34 are confined within their sockets 28 and 30, pivotal movement of the extensions 36 and 40 by the connector member 62 will produce a corresponding pivotal or rotating movement of the eyes.

Referring again to FIG. 1, the actuator 46 is shown mounted for rotating movement, the flange 54 being confined within the annular slot 55 that is formed when the forward portion 2 and rear portion 14 are secured together. The flange 54 of the actuator 46 rests on the bottommost wall of the slot 55 in bearing relation, thereby enabling the actuator 46 to be movable in a rotating action. The slot 59 as formed in the wall of the rear portion 14 extends in a horizontal direction, thereby enabling the actuating arm 58 to be laterally moved therein. As the actuating arm 58 is laterally moved by the user of the doll, the actuator 46 is rotated in a corresponding manner. As shown in FIG. 2, the actuator arm 58 is disposed in a central position within the slot 59, the projection 60 also being centrally disposed and the eyes 32 and 34 being located such that they appear to be directed forwardly through the openings 26 and 27. In order to effect a right-hand, sidewise glance, the actuator arm 58 is moved upwardly as illustrated in FIG. 2, or to the right when holding the doll, thereby producing a counterclockwise movement of the actuator 44 as indicated by the arrow in FIG. 5, wherein the projection 60 is carried therewith. As the projection 60 is moved toward the left eye of the doll, the connecting member 62 is moved in a linear direction therewith. This causes the extensions 36 and 40 to be shifted accordingly and to pivot the eyes 32 and 34 to effect what appears to be a right-hand, sidewise glance of the eyes of the doll. When an opposite movement of the eyes is to be produced, the actuator arm 58 is reversely moved in the slot 59 to rotate the actuator member 46 in a clockwise direction, thereby moving the connector member 62 in a linear direction toward the eye 32 or upwardly as seen in FIG. 6. The eyes of the doll will thus appear to shift leftward with respect to the head of the doll.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A mechanism for effecting movement of simulated eyes as mounted in the head of a doll construction, said head being formed with an interior chamber in which sockets are located for receiving the eyes therein, openings formed in said head and communicating with said sockets to provide visual access to said eyes exteriorly of said head, an actuator mounted for rotating movement in said head, a connector member operatively connected to said actuator and being responsive to rotating movement thereof for movement in a linear direction, said eyes being interconnected to said connector member and being movable in said sockets in response to linear movement of said connector member, and an operator joined to said actuator and being movable to produce the rotating movement of said actuator and the corresponding linear movement of said connector member, wherein a variety of positions of said eyes as moved in said sockets are selectively obtained.

2. A mechanism as claimed in claim 1, said actuator including a body to which a projection is joined, said connector member including an elongated portion to which said projection is connected intermediate the ends thereof, wherein rotating movement of said body produces the corresponding linear movement of said connector member.

3. A mechanism as claimed in claim 2, each of said eyes having an extension joined thereof and projecting rearwardly thereof, means formed on the opposed ends of the elongated portion of said connector member for loosely engaging said extensions so that linear movement of said connector member produces a corresponding pivotal movement of said eyes in said sockets.

4. A mechanism as claimed in claim 1, said actuator having a body of generally cylindrical configuration to which an annular guide element is joined, and an annular groove formed interiorly of said head and communicating with said chamber for receiving said guide element therein, thereby providing for the rotating movement of said actuator.

5. A mechanism as claimed in claim 4, said annular guide element being formed on the lowermost end of said body and defining an annular flange that is received in said groove in supporting relation on a surface thereof.

6. A mechanism as claimed in claim 5, a projection joined to said body and extending forwardly therefrom intermediate the top and bottom ends thereof, said connector member including an elongated bar member on the central portion of which an enlargement is formed in which an opening is located, said projection extending into the opening in said enlargement so that the rotating movement of said actuator produces a linear movement of said connector member.

7. A mechanism as claimed in claim 6, each of said eyes being defined by a spherical element to which an extension is joined, each of said extensions being interconnected to said connector member and being responsive to linear movement thereof to effect a pivotal movement of said eyes in the sockets thereof.

8. A mechanism as claimed in claim 7, a slot formed in each extension, and a pin element projecting loosely through each slot to interconnect the connector member to said extensions.

9. A mechanism as claimed in claim 1, said actuator including a body having a flange formed on the lowermost end thereof, said operator being joined to said flange and depending therefrom and including a lever arm that projects outwardly of said head through a slot formed therein for exterior access by a user.

10. A mechanism as claimed in claim 9, said slot extending generally horizontal in said head, wherein the lever arm of said actuator is movable in a generally lateral direction to produce a corresponding rotary movement of said actuator.

* * * * *